US006288314B1

(12) United States Patent
Cohen et al.

(10) Patent No.: US 6,288,314 B1
(45) **Date of Patent: *Sep. 11, 2001**

(54) BLOW-MOLDED SHAKER

(76) Inventors: Wayne Cohen, 44 Convent Road Silom, Bangrak, Bangkok (TH), 10500; Donald Kralik, 249 Pt. Breeze Dr., Hewitt, NJ (US) 07421

( * ) Notice: Subject to any disclaimer, the term of this patent is extended or adjusted under 35 U.S.C. 154(b) by 0 days.

This patent is subject to a terminal disclaimer.

(21) Appl. No.: 09/242,052

(22) PCT Filed: Aug. 12, 1997

(86) PCT No.: PCT/US97/13955

§ 371 Date: Dec. 30, 1999

§ 102(e) Date: Dec. 30, 1999

(87) PCT Pub. No.: WO98/07138

PCT Pub. Date: Feb. 19, 1998

Related U.S. Application Data

(63) Continuation-in-part of application No. 08/695,639, filed on Aug. 12, 1996, now Pat. No. 5,808,215.

(51) Int. Cl.[7] ..... G10D 13/08

(52) U.S. Cl. ..... 84/402; 84/403; 446/419; D17/22

(58) Field of Search ..... 84/402, 403, 404; 446/419, 421; D17/22

(56) References Cited

U.S. PATENT DOCUMENTS

| | | | | |
|---|---|---|---|---|
| 2,318,460 | | 5/1943 | Brief | 446/419 |
| 2,399,333 | * | 4/1946 | Desmond | 446/419 |
| 4,077,297 | | 3/1978 | Woodson | 84/411 R |
| 4,164,284 | * | 8/1979 | Witt et al. | 206/217 |
| 4,721,232 | * | 1/1988 | Federighi | 222/196.5 |
| 4,833,964 | | 5/1989 | Prouty | 84/411 R |
| 4,850,496 | * | 7/1989 | Rudell et al. | 215/12.1 |
| 4,869,146 | | 9/1989 | Bonsor | 84/413 |
| 5,044,250 | | 9/1991 | Beyer | 84/422.4 |
| 5,237,903 | | 8/1993 | Bein et al. | 84/404 |
| 5,265,514 | | 11/1993 | Schertz | 84/422.4 |
| 5,377,575 | * | 1/1995 | Huth, III | 84/402 |
| 5,483,859 | | 1/1996 | Singer | 84/322 |
| 5,659,143 | | 8/1997 | Isackson | 84/402 |

FOREIGN PATENT DOCUMENTS

| | | |
|---|---|---|
| 0341195 | 11/1989 | (EP) . |
| 2109332 | 6/1983 | (GB) . |
| 319938 | 6/1956 | (JP) . |
| 3111144 | 7/1956 | (JP) . |
| 3926891 | 9/1964 | (JP) . |
| 60120494 | 8/1985 | (JP) . |
| 266831 | 12/1995 | (TW) . |
| WO9527544 | 10/1995 | (WO) . |

OTHER PUBLICATIONS

European Search Report, Aug. 31, 1999 The Hague.

Translation of German to English of European Publication No. 0,341,195 A2.

* cited by examiner

*Primary Examiner*—Shih-Yung Hsieh
(74) *Attorney, Agent, or Firm*—Baker Botts L.L.P.

(57) ABSTRACT

A musical shaker instrument has a shaped shell and pellets enclosed therein. The shell has two parts. A first large shell part (24) includes an exterior surface forming a first end portion and a central portion. The first part truncates at a second end portion of the shell and includes an opening (26) in the truncated end portion. The second small shell part (30) has a cap member (32) for closing opening in the first large shell part. The first and second shell parts are joined together by an internal joint which is not exposed to the external surface of the shell. In a second embodiment, the second shell part forms a handle.

4 Claims, 3 Drawing Sheets

BLOW-MOLDED SHAKER

This Application is a Continuation-In-Part of application Ser. No. 08/695,639, filed Aug. 12, 1996, now U.S. Pat. No. 5,808,215.

FIELD OF THE INVENTION

The present invention relates to the field of musical instruments and more specifically to a noise making type of musical instrument known as a maraca or a musical shaker.

BACKGROUND OF THE INVENTION

Maracas and musical shakers are often used in the rhythm sections of orchestras and other musical groups to establish rhythm in musical performances of all kinds. The maraca generally comprises a spherically shaped dried and hollowed gourd containing dried seeds or other pellets that produces a "rattle" sound when it is shaken.

Another musical shaker is disclosed in U.S. Pat. No. 4,179,973 to White. The White musical shaker comprises a generally tubular, hollow casing having a reduced geometry at one end and which is filled with popcorn kernels or other sound generating kernels, pellets or the like that generate musical or other tones when shaken by the user.

Another musical shaker, this one having an egg shape, is presently sold by Daito Incorporated under the registered trademark CHICKEN SHAKE. The device is fabricated in a manner similar to toy plastic eggs, i.e., it is formed by injection molding such that a seam is formed between two egg shape members joined around the widest portion of the shell. There are a number of very undesirable problems associated with this particular design. First, the egg shaped device has a tendency to break along the seam when the instrument is dropped. The expense associated with continually replacing a cracked device may become prohibitive. Second, children playing with the device may be injured if it cracks because they may eat the fill inside the device or cut themselves with the jagged edges of the cracked device. Third, a relatively large amount of adhesive is required for assembly because the seam is located at the widest section of the device. Fourth, assembly of the device takes an excessive amount of time because during assembly the excess adhesive oozing from the seam must be cleaned or scraped away from the outer surface of the shell. Thus, there is a clear need for a musical shaker, and particularly an egg shaped musical shaker which overcomes the above-mentioned problems.

SUMMARY OF THE INVENTION

Accordingly, it is the primary object of the present invention to disclose an egg shaped musical shaker which does not easily crack when it is dropped on the ground.

Another object of the invention is to provide an egg shaped shaker which is safe for children.

Another object of the invention is to provide a musical shaker that has an internal joint which is not exposed to the external surface of the shaker.

Another object of the present invention is to provide a musical shaker which does not have a seam around the widest portion of its shell.

Another object of the present invention is to provide a musical shaker that is durable, easy to handle and easy to store.

Another object of the present invention is to provide a musical shaker having a shell which is formed with an opening at one end and a cover that is secured over the opening and glued in place.

Another object of the invention is to provide a musical shaker that requires less adhesive to assemble.

Another object of the invention is to provide a musical shaker that can be simply and inexpensively manufactured.

Another object of the invention is to disclose an egg shaped musical shaker having a handle and a variety of shapes.

A first embodiment of the present invention is a musical shaker comprising an egg shaped shell and pellets enclosed within the shell. The egg shaped shell is formed in two parts, a first large shell part and a second small shell part. The first large shell part is blow-molded. This production method differs from the injection-molded method used to produce the prior art CHICKEN SHAKE device. The first large shell part has an exterior surface forming one end portion and a central portion. The first large shell part is truncated in the other end portion of the shell and includes an opening with a bottleneck extension. The second small shell part comprises an end portion of the egg shaped shell. The second small shell part further comprises a cap member having an internal hub for receiving the bottleneck extension and closing the opening in the first large shell part. After the first large shell part is fabricated by blow molding, the pellets are inserted therein through the opening. A small amount of adhesive is placed on the bottleneck of the opening and the internal hub is secured over the opening. The bottleneck and the internal hub form an internal joint which is not exposed to the external surface of the device. When the adhesive dries, the second small shell part is permanently secured to the first large shell part. Assembly of this device is simpler than prior art devices because there is no need to scrape away excess glue from an exposed joint. In addition, the joint is less likely to crack because it is not directly exposed to external forces acting upon the surface of the shell.

The egg shaped shell has an axis of rotational symmetry. The shell has its maximum dimension along this axis. The shell also has a plane of maximum transverse radius which is perpendicular to the axis of rotational symmetry. The plane of maximum transverse radius is located closer to the larger end of the shell than it is to the smaller end of the shell. The first large shell part is truncated on a plane perpendicular to the axis of rotational symmetry, between the plane of maximum transverse radius and one end of the shell. In a preferred embodiment the plane of truncation is between the plane of maximum transverse radius and the small end and is closer to the small end than to the plane of maximum radius.

In a second embodiment, the musical shaker comprises a first part, i.e., an egg shaped shell section and pellets enclosed therein. The first part has an exterior surface forming an end portion and a central portion of the egg shaped shell section. The first part is truncated in the other end portion thereof and includes an opening in the truncated small end portion. The musical shaker has a plug for scaling the opening in the first part to contain the pellets inside the first part. The second embodiment also includes a handle for covering the sealed opening. The handle has an internal hub for receiving the bottleneck extension from the opening. The internal joint formed by the bottleneck and the internal hub is not exposed to the external surface of the shaker.

A third embodiment is similar to the second embodiment in construction, but the first part is shaped like the body of a bottle and the handle is formed like a bottle neck.

The proposed device is much safer and more durable than prior art devices because the weakest point of the structure, i.e., the internal joint, is not exposed to an external surface. In addition, assembly of the proposed device is more efficient because less glue is required and excess glue does not have to be cleaned from the external surface. Additionally, the proposed device is an aesthetic improvement because the joint is not located in a prominent position in the center of the shaker. Finally, the device is safer because it is less likely to crack or break.

Other objects, advantages and novel features of the present invention will become apparent when considered in conjunction with the accompanying drawings.

BRIEF DESCRIPTION OF THE DRAWINR

Figure 5:
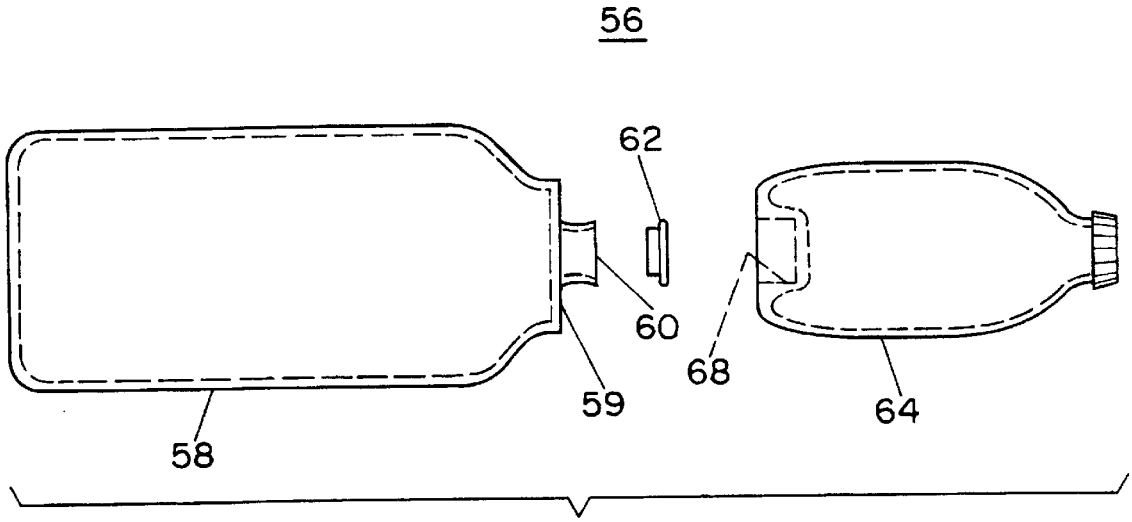

FIG. 5. shows an exploded side view of a third embodiment of the inventive shake having a bottle shape.

DESCRIPTION OF THE PREFERRED EMBODIMENT

The invention will be described in detail with reference to FIGS. 1–5.

Figure 1:
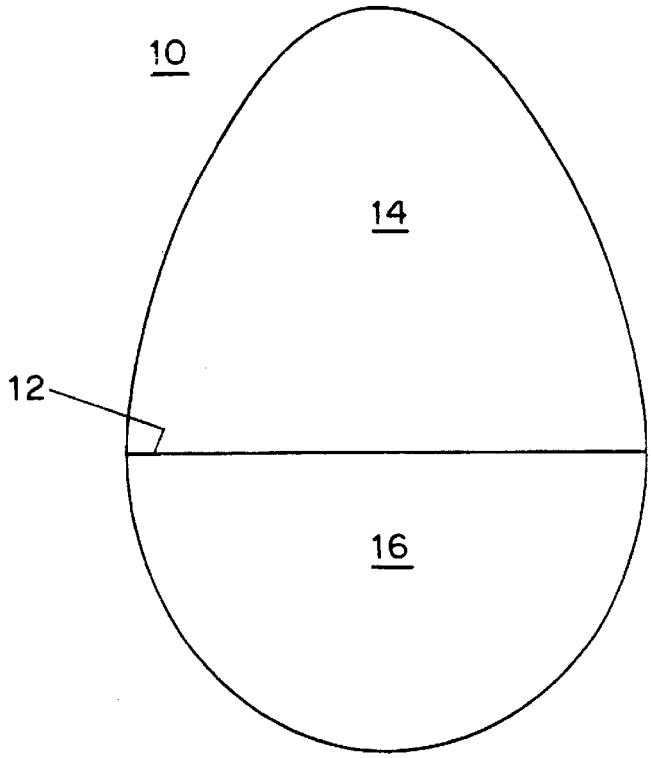
FIG. 1 PRIOR ART
FIG. 1 shows a side view of a prior art musical shaker.

FIG. 1 illustrates a side view of a prior art musical shaker device 10. The egg shaped device 10 is formed by injection molding such that a seam 12 is formed between first 14 and second 16 halves of the device 10. FIG. 1 clearly shows that the seam 12 is formed around the widest transverse portion of the device 10. In other arrangements, a seam is formed around the largest longitudinal portion of the device. When the prior art device 10 is dropped or it falls to the ground, there is a tendency that it will strike the ground along the seam 12, the weakest structural point on the device 10. As a result, the device 10 has a tendency to crack along the seam 12 when it strikes the ground. Once the seam 12 cracks, the device 10 is unusable, unsafe and must be disclosed. In addition, production of the device uses an excessive amount of glue because the seam is located along the widest part of the egg. Moreover, assembly of the device is cumbersome because excess glue which may ooze from the seam during assembly must be cleaned or scraped away.

Figure 2:
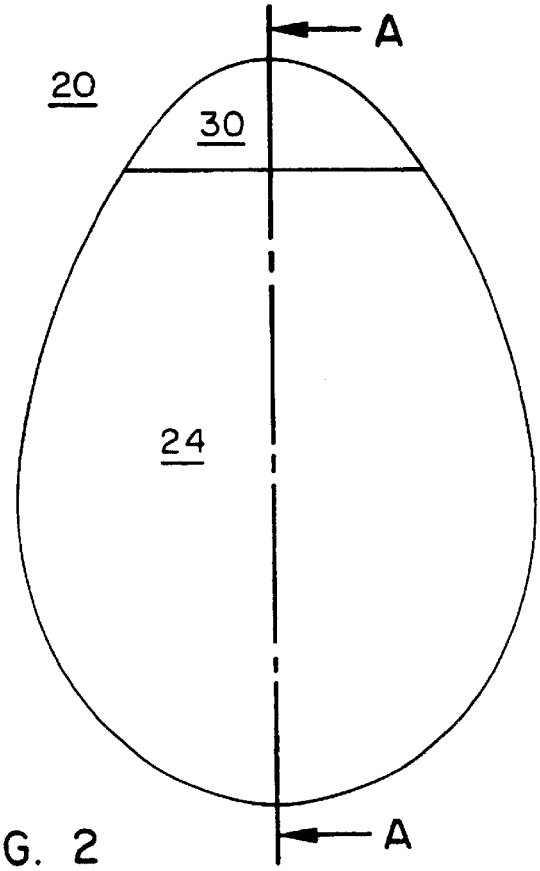
FIG. 2 shows a side view of a first embodiment of the inventive egg shaped shaker.
Figure 3:
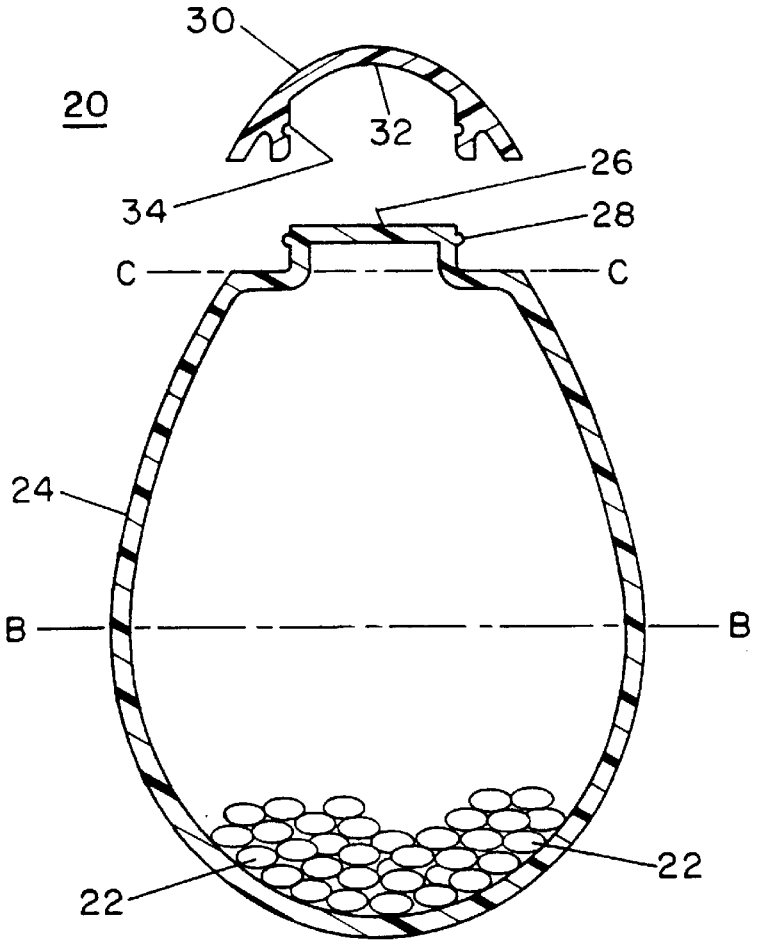
FIG. 3 is an exploded cross-section of the egg shaped shaker shown in FIG. 2.

FIGS. 2 and 3 show respective side and cross-sectional views of a first embodiment of the musical shaker 20 of the present invention. The musical shaker 20 comprises an egg shaped shell and pellets 22 enclosed therein. The egg shaped shell 20 is preferably formed from a hard plastic material although it is within the scope of this invention to utilize other materials.

The shell 20 is formed in two parts. A first large shell part 24 includes an exterior surface forming a large end portion and a central portion of the egg shaped shell. The first large shell part 24 is truncated in a small end portion of the shell and includes an opening 26 with a bottleneck extension 28. The shell 20 also includes a second small shell part 30 comprising a small end portion of the egg shaped shell. The second small shell part 30 has a cap member 32 including an internal hub 34 for receiving the bottleneck extension 28 and closing the opening 26. The bottleneck extension 28 and the internal hub 34 are joined together with an adhesive to form an internal joint which is not exposed to the external surface of the device.

The device 20 has an axis of rotational symmetry A—A which lies along the shell's maximum dimension. The shell also has a plane of maximum transverse radius B—B which is perpendicular to the axis A—A and which is located closer to the larger end of the shell than the smaller end of the shell. The first large shell part 24 is truncated on a plane C—C perpendicular to the axis A—A between the maximum transverse radius plane B—B and the small end. The plane C—C is closer to the small end than it is to the maximum radius plane B—B.

It will be recognized that as an alternative construction, the large shell part could be fabricated to include the entire small end of the shell with the truncation thereof being between the maximum radius plane B—B and the large end of shell 20.

Figure 4:
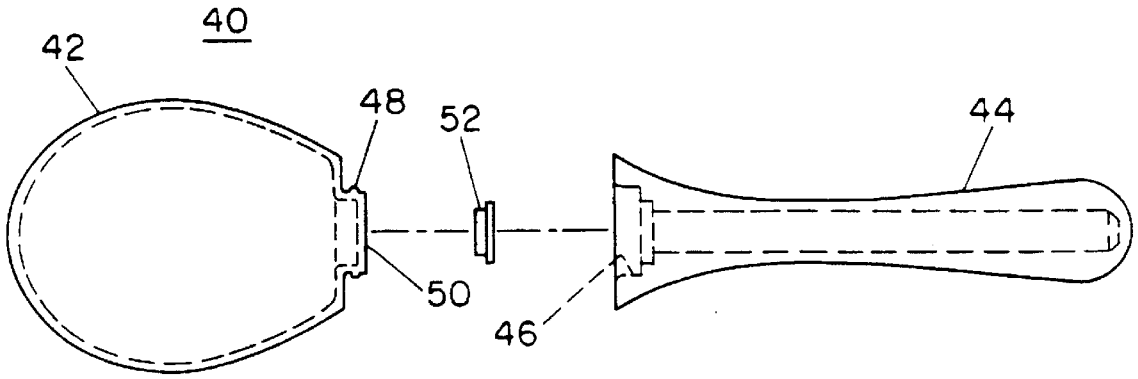
FIG. 4 shows an exploded side view of a second embodiment of the inventive shaker including a handle.

FIG. 4 shows an exploded side view of a second embodiment 40 of the inventive shaker. In the second embodiment 40 the first large shell part 42 remains unchanged from the design shown in FIGS. 2 and 3 (see reference numeral 24); however, the second small shell part 30 shown in FIG. 3 has been replaced with a handle 44. After the pellets (not shown) have been inserted inside the first large shell part 42, a plug 52 is glued into the opening 50 to seal the pellets inside the first large shell part 42. An internal hub 46 within the handle 44 is then fit over and covers the bottleneck extension 48. Preferably, an adhesive or glue joins the hub 46 and the bottleneck extension 48. The joinder of the bottleneck extension 48 and the hub 46 forms an internal joint which is not exposed to the external surface of the device.

FIG. 5 is an exploded view of a third embodiment 56 of the inventive shaker. In the third embodiment 56, a large shell part 58 is blow molded into the shape of a beverage bottle having a truncation 59 in the smaller diameter neck region. Plug 62 closes large shell part 58 and handle 64 having an internal hub 68 is fit onto and preferably glued onto extension 60 of shell part 58.

While third embodiment 56 is a bottle shaped shaker, suitable, e.g. for promotion by imitation of a beverage bottle, rather than an egg shape, the same construction and advantages apply.

While the above description constitutes the preferred embodiments of the present invention, it will be appreciated that the invention is susceptible to modification, variation and change without departing from the proper scope and the fair meaning of the accompanying claims. For example, the musical shaker could also be designed in the shape of a sphere, a cylinder, a triangle, or any other shape whereby a portion of the instrument includes a cap member for closing an opening.

What is claimed is:

1. A shaker instrument comprising first and second parts, said first part comprising a hollow blow molded shall with pellets therein, said shell having a truncated end portion and a bottleneck extending from said truncated end portion, said second part comprising a handle member having a truncated end portion and a hub in said truncated end portion for receiving said bottleneck of said first part, said first and second parts having shaped exterior surfaces which join together at said truncated end portions to form a continuous shaped exterior surface of said instrument.

2. A shaker instrument as specified in claim 1, wherein said first shell part is provided with a plug closing said bottleneck and retaining said pellets in said first part.

3. A shaker instrument as specified in claim 1 wherein said exterior surface forms a maraca having a shell shaped end, and wherein said shell shaped end comprises said first part and a portion of said second part.

4. A shaker instrument as specified in claim 1 wherein said exterior surface forms the shape of a bottle.

* * * * *